US005626407A

United States Patent [19]

Westcott

[11] Patent Number: 5,626,407

[45] Date of Patent: May 6, 1997

[54] STORAGE SYSTEM FOR REFRIGERATORS

[75] Inventor: Michael Westcott, Cohasset, Mass.

[73] Assignee: Emplast, Inc., Shakopee, Minn.

[21] Appl. No.: 643,307

[22] Filed: May 10, 1996

[51] Int. Cl.[6] ..... A47B 96/04; A47F 5/00

[52] U.S. Cl. ..... 312/408; 312/351; 211/87; 108/108; 248/243

[58] Field of Search ..... 312/404, 408, 312/405.1, 351; 211/34, 75, 87, 88, 94; 108/42, 108; 248/235, 243, 222.51

[56] References Cited

U.S. PATENT DOCUMENTS

| | | | |
|---|---|---|---|
| 2,103,885 | 12/1937 | Whalen . | |
| 2,239,369 | 4/1941 | Nauert . | |
| 2,270,844 | 1/1942 | Hedlund . | |
| 2,976,098 | 3/1961 | Combs . | |
| 3,339,994 | 9/1967 | Reddig et al. | 312/351 |
| 3,469,711 | 9/1969 | Swaneck et al. . | |
| 3,698,565 | 10/1972 | Weber | 211/87 |
| 3,886,698 | 6/1975 | Raith et al. | 211/87 X |
| 4,365,562 | 12/1982 | Webb . | |
| 4,726,554 | 2/1988 | Sorrell | 248/222.51 |
| 4,936,641 | 6/1990 | Bussan et al. . | |
| 5,323,917 | 6/1994 | Johnson et al. . | |
| 5,346,299 | 9/1994 | Werkmeister et al. . | |
| 5,375,924 | 12/1994 | Pohl et al. . | |
| 5,397,006 | 3/1995 | Terrel . | |

FOREIGN PATENT DOCUMENTS

| | | | |
|---|---|---|---|
| 801279 | 1/1951 | Germany | 312/408 |

*Primary Examiner*—Peter M. Cuomo
*Assistant Examiner*—James O. Hansen
*Attorney, Agent, or Firm*—Haugen and Nikolai, P.A.

[57] ABSTRACT

An improved storage system for use in refrigerators is disclosed. The system includes a rack which can be supported from a wire or glass shelf in the refrigerator against the refrigerator's wall. The rack includes means for supporting a plurality of containers which could include trays, bottle holders or the like.

4 Claims, 7 Drawing Sheets

STORAGE SYSTEM FOR REFRIGERATORS

BACKGROUND OF THE INVENTION

I. Field of the Invention

The present invention relate to shelving and racks for supporting a variety of articles. More particularly, the invention relates to an improved storage system for use in refrigerators.

II. Description of the Prior Art

Various racks and storage bins have been used in conventional household refrigerators. Such racks and bins are typically supported within the refrigerator in one of two ways. The first way is to attach the rack or bin to the wall or door of the refrigerator using pins or tracks secured to the wall or door. The second technique is simply to have the bin supported on or clipped to a wire refrigerator shelf. Examples of the first technique are shown, for example, in U.S. Pat. No. 3,469,711 which issued on Sep. 30, 1969 to A. J. Swaneck et al., U.S. Pat. No. 5,346,299, which issued on Sep. 13, 1994 to Werkmeister et al., and U.S. Pat. No. 5,375,924 which issued on Dec. 27, 1994 to Pohl et al. Other examples of this first technique are shown in U.S. Pat. No. 4,365,562 which issued to Webb on Dec. 28, 1992, U.S. Pat. No. 4,936,641 which issued to Bussan et al. on Jun. 26, 1990 and U.S. Pat. No. 2,976,098 which issued on Mar. 21, 1961 to Combs. Examples of the second technique, i.e., trays supported on or clipped to a refrigerator shelf, are shown, for example, in U.S. Pat. No. 2,103,885 to Whalen, U.S. Pat. No. 2,239,369 to Nauert and U.S. Pat. No. 2,270,884 to Hedlund.

The systems shown in the patents referenced above, have several disadvantages. Shelves or bins mounted by way of the first technique are generally not suitable for installation after the refrigerator has been delivered to the homeowner. The use of such systems generally must be planned during manufacture of the refrigerator. This greatly reduces the flexibility of such systems in meeting the needs of particular users of the refrigerator. While shelves and bins which are mounted by way of the second technique provide greater flexibility, supporting them on a refrigerator shelf can have the effect of severely limiting the remaining shelf space available after the bin is installed.

Efforts to overcome such problems are represented by the Terrel U.S. Pat. No. 5,397,006, which issued on Mar. 14, 1995, and the Johnson et al. U.S. Pat. No. 5,323,917, which issued on Jun. 18, 1994. The Terrel patent relates to a system which includes a variety of storage trays having lips designed to engage slots on a mounting plate. This mounting plate is designed to be attached to the wall of a refrigerator by screws or by an adhesive, or by a separate mounting bracket which is not shown in the patent. While the Terrel system does provide added flexibility, the user of the system is still required to drill screw holes or the like into the walls of the refrigerator in order to hold the Terrel storage system in place. Otherwise, an appropriate adhesive must be used to mount the storage tray system to the wall of the refrigerator. In either event, this task is inconvenient for a homeowner and constitutes permanent placement of the rack, again reducing flexibility. The Johnson patent shows a system which solves the requirement for permanent mounting. However, the Johnson system is less flexible in that it discloses a single bin rather than a system which includes a plurality of bins that can be inserted or removed as desired by the homeowner.

There is, therefore, a real need for a rack system for use in a refrigerator which is easily installed and removed, does not require any permanent mounting, is flexible in terms of the nature of the shelving it can accommodate, and is limited in the amount of space which it occupies.

SUMMARY OF THE INVENTION

It is an object of the present invention to provide a refrigerator rack for storing and dispensing a variety of articles.

Another object of the present invention is to provide an improved refrigerator rack which is of simple construction, economical to manufacture, and easy to install in a refrigerator.

Another object of the invention is to provide an improved storage rack which is supported by existing shelving within a conventional refrigerator and is easily removed from the refrigerator.

Still another object of the invention is to provide a storage system which includes a rack and a plurality of trays which can be selectively positioned on and supported by the rack.

These and other objects of the invention shall become more readily apparent from the following detailed description of the preferred embodiment, when read in conjunction with the drawings, and in view of the claims, all of which comprise this specification.

DETAILED DESCRIPTION OF THE PREFERRED EMBODIMENT

Figure 1:
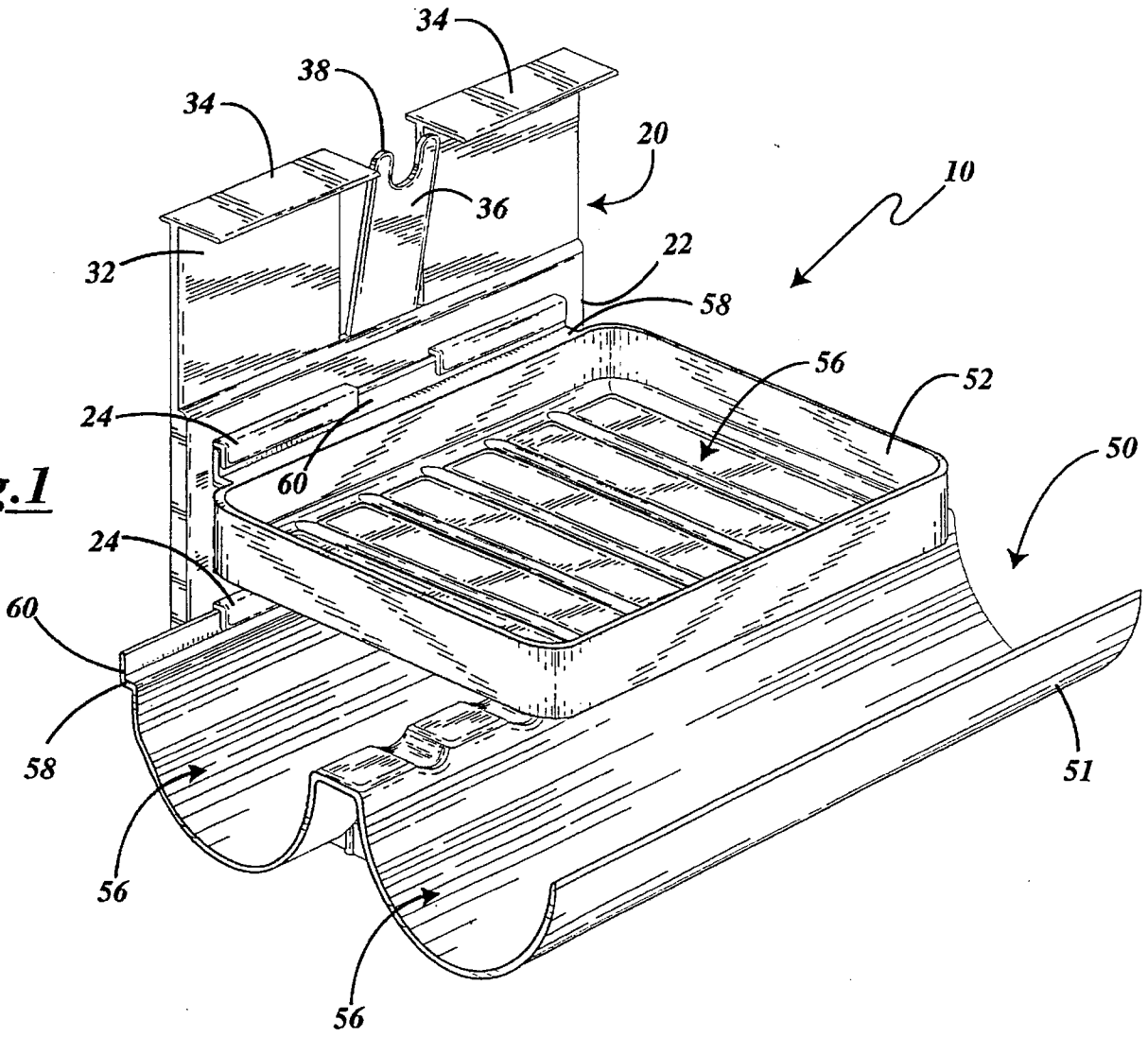
FIG. 1 is a perspective view of an improved refrigerator rack in combination with two trays attached to the rack for storing and dispensing a variety of articles.
Figure 2:
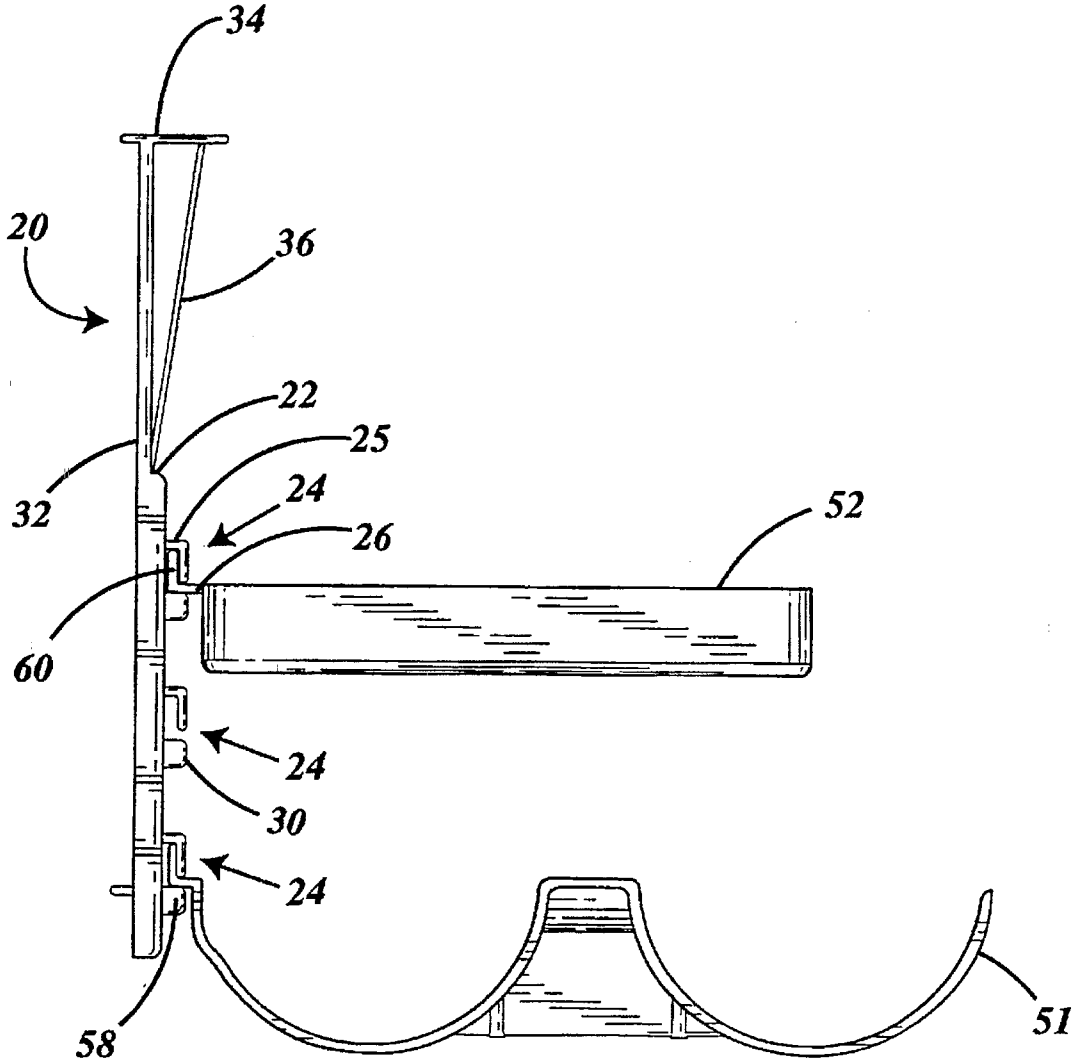
FIG. 2 is a side plan view of the rack shown in FIG. 1.
Figure 3:
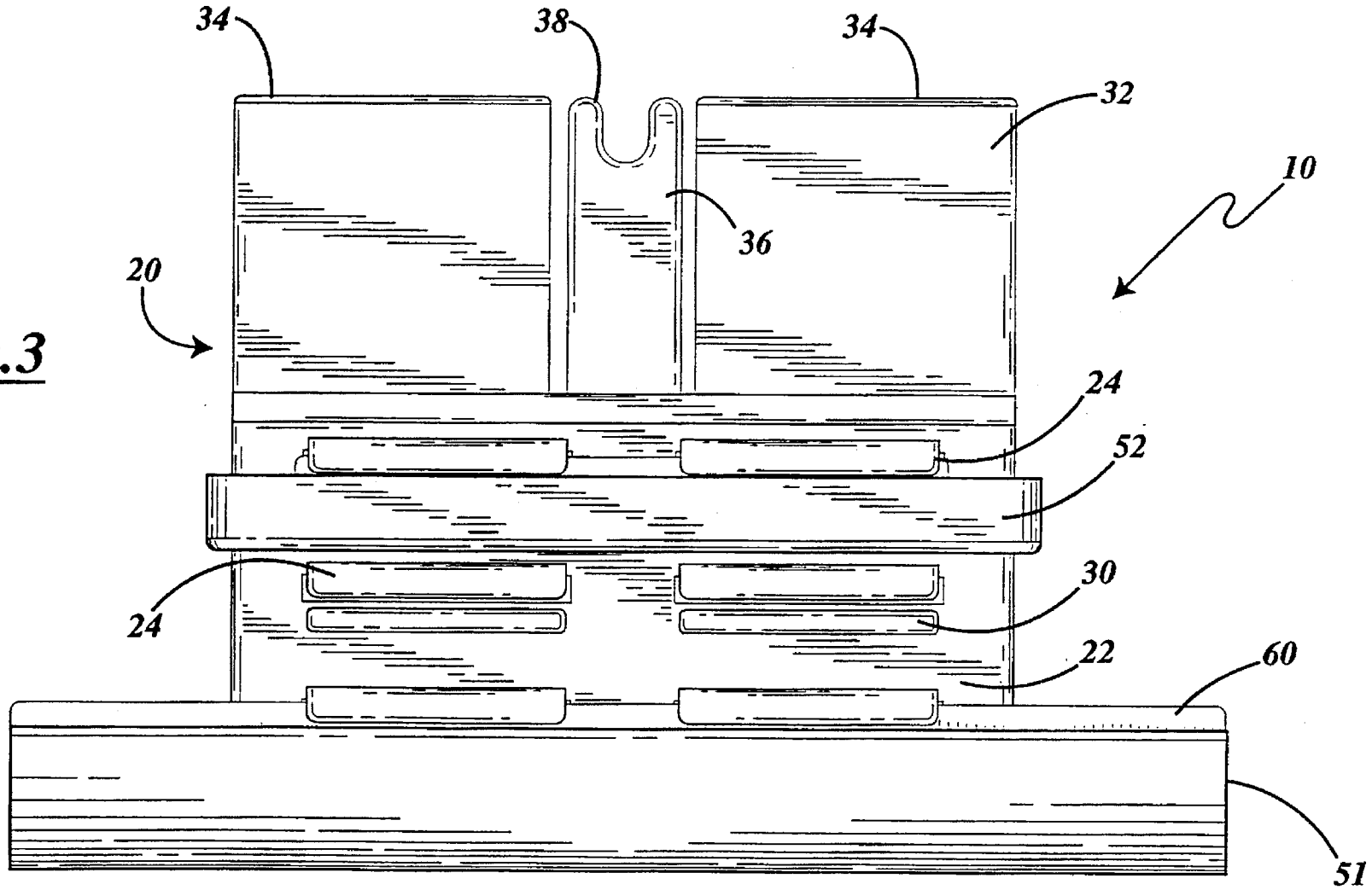
FIG. 3 is a front plan view of the rack shown in FIG. 1.
Figure 4:
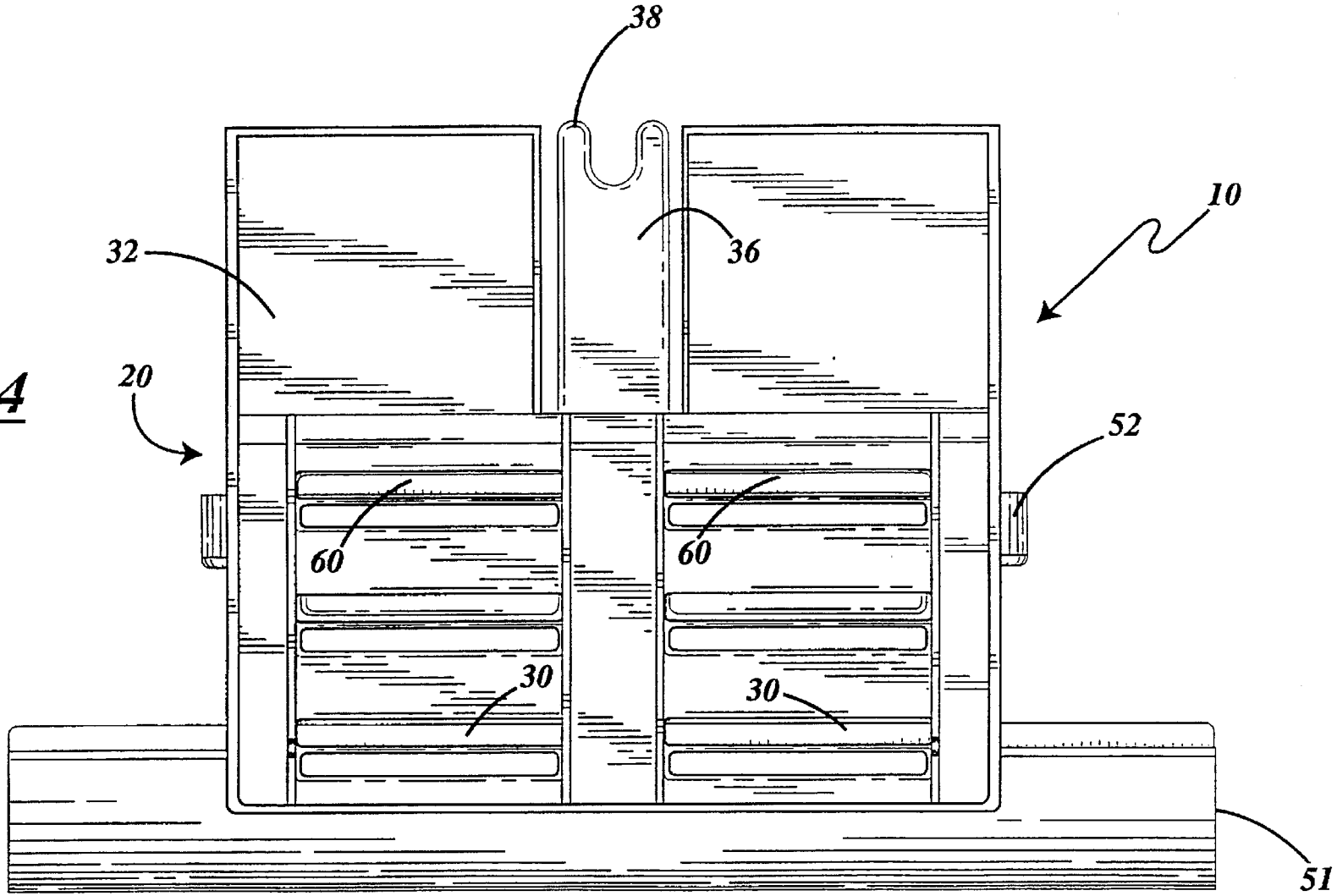
FIG. 4 is a back plan view of the rack shown in FIG. 1.
Figure 5:
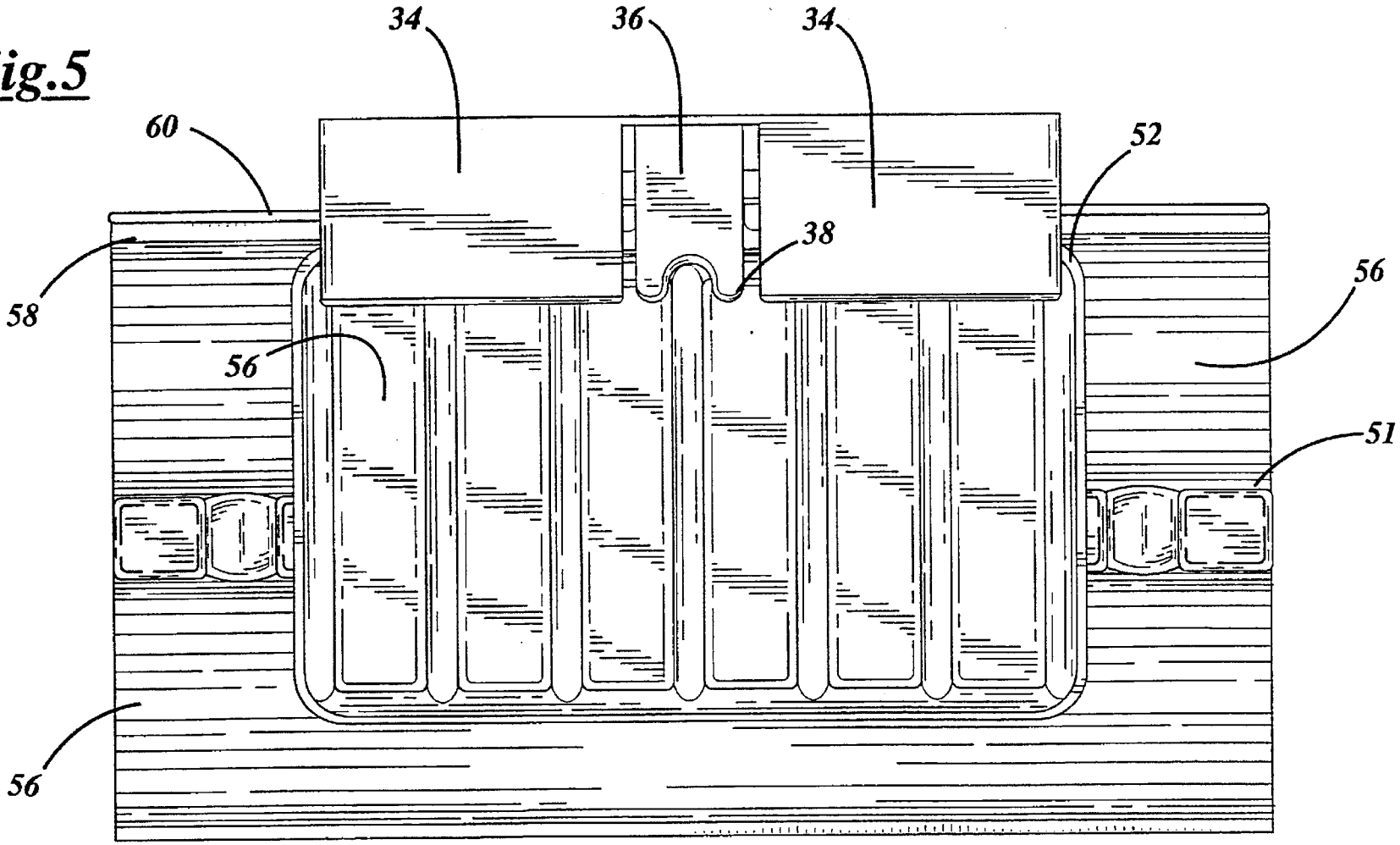
FIG. 5 is a top plan view of the rack shown in FIG. 1.
Figure 6:
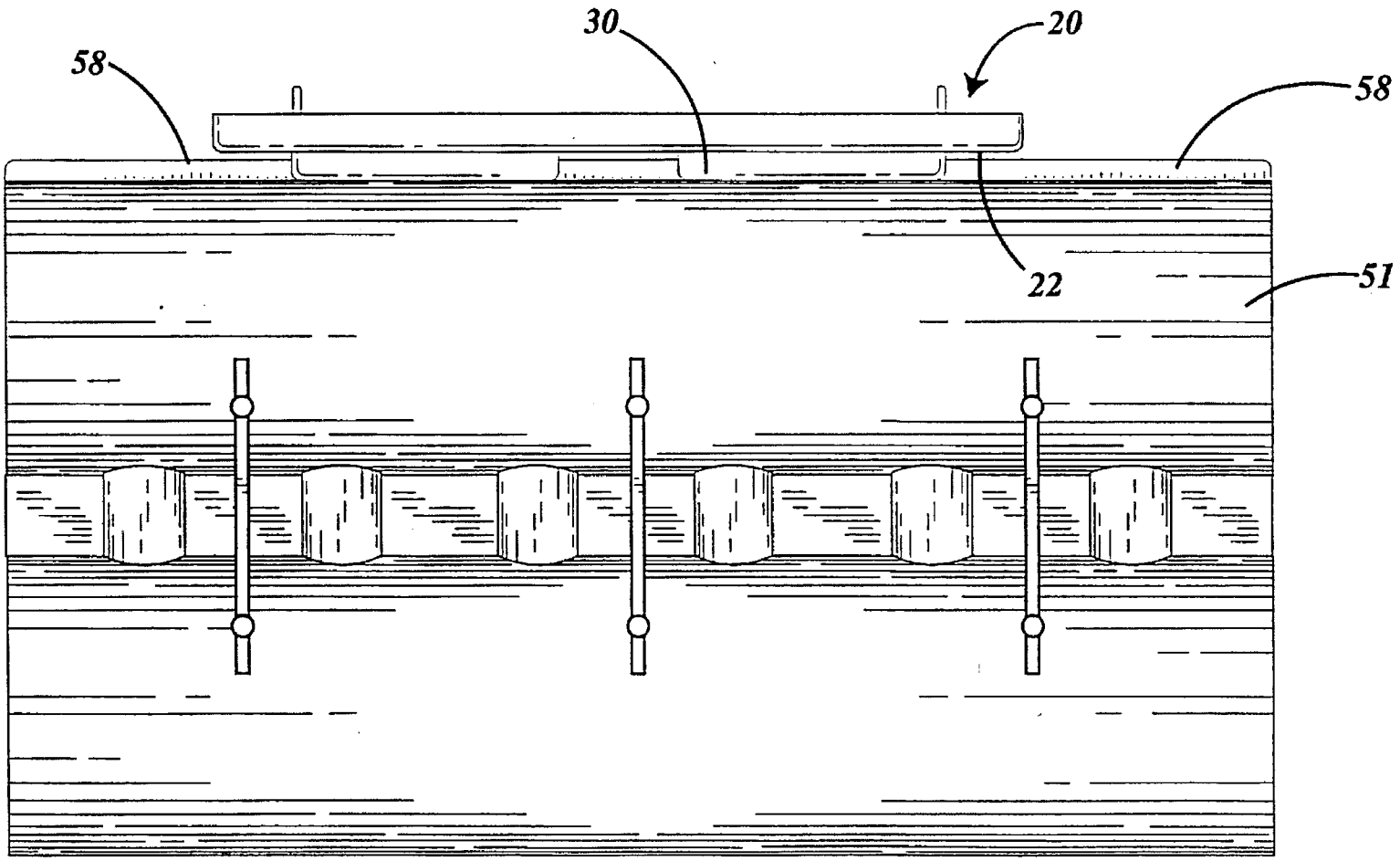
FIG. 6 is a bottom plan view of the rack shown in FIG. 1.

A refrigerator system in accordance with the preferred embodiment of the invention shall now be described in conjunction with the drawings. As shown in the drawings, improved storage system 10 includes a rack 20 and a plurality of trays 50, such as those shown, for example, as 51 and 52. The storage system 10 is designed to be used inside of a refrigerator having a plurality of shelves. The shelves may be made either of wire mesh such as shelf 2 shown in FIG. 8 or a solid material (for example, glass) such as the shelf 3 shown in FIG. 7. The shelves are fixed to the walls 3 of the refrigerator, using any standard attachment mechanism.

As shown in the drawings, the rack 20 includes a vertically oriented surface 22. Projecting inwardly toward the center of the refrigerator from the vertically oriented surface 2 are a plurality of retaining hooks 24 and a plurality of support members 30. The retaining hooks 24 have a wall 25 projecting from the vertically oriented surface 22 and a wall 26 projecting downwardly from wall 25. The walls 25 and 26 which form retaining hooks 24 have an inner surface and an outer surface.

The support members 30 also project inwardly toward the center of the refrigerator from the vertically oriented surface 22. As shown in the drawings, each support member 30 is aligned with and positioned just below one of the retaining hooks 24. The support members 30 are also spaced from the bottom of the hooks 24.

Figure 7:
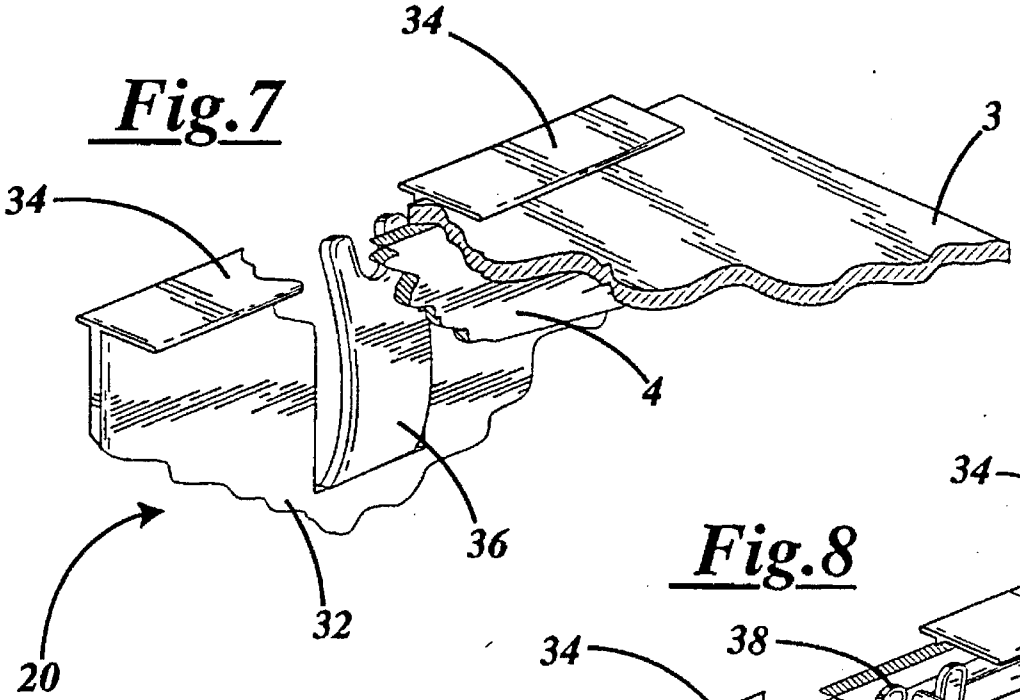
FIG. 7 is a perspective view showing the means for attaching the rack to a solid refrigerator shelf.
Figure 8:
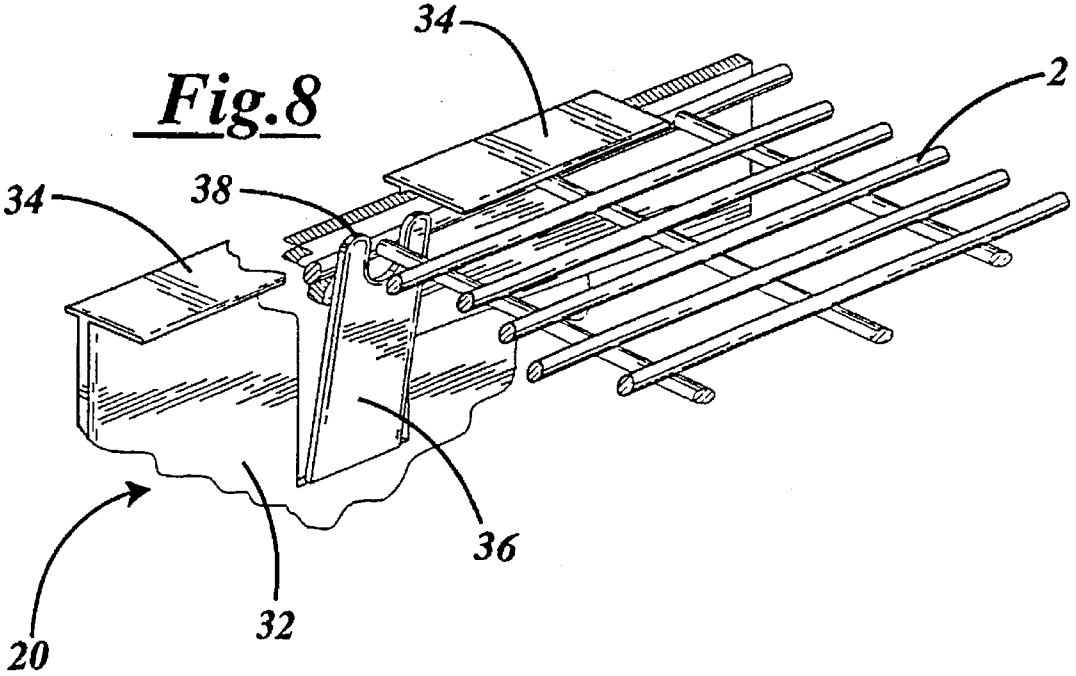
FIG. 8 is a perspective view showing the means for attaching the rack to a wire type refrigerator shelf.

Projecting upwardly from the vertically oriented surface 22 are a pair of mounting members 32. The mounting members 32 terminate in a top flange 34 which extends inwardly toward the center of the refrigerator. As shown in FIGS. 7 and 8, when in use, the inwardly extending top flange 34 rests on top of the refrigerator shelf 2 or 3 to support the rack 20.

To enhance the stability of the system, also provided is a biasing member 36. This biasing member is typically integrally molded with the remaining components of the rack 20. The biasing member 36 has a top member 38 which is forked. When the rack 20 is mounted to a solid shelf 3 as shown in FIG. 7, biasing member 36 is designed to engage the side 4 of the shelf 3. The biasing member 36 serves to force the back of rack 20 toward the wall of the refrigerator, providing additional and tighter support for the rack 20. When the rack 20 is mounted to a wire type shelf 2 as shown in FIG. 8, the forked top member 38 of biasing member 36 grips one of the wires of the shelf 2 to prevent the rack 20 from moving sideways in the refrigerator. The biasing member 36 also tends to force the back of rack 20 against the refrigerator wall.

As shown in the drawings, a variety of trays 50 can be used in conjunction with the rack 20. Each tray 50 has at least one receptacle 56, a first wall 58 projecting outwardly from at least one of the receptacles 56, and a second wall 60 projecting upwardly from the first wall 58. The first wall 58 and the second wall 60 on the trays 50 combine with the retaining hooks 24 and support members 30 on the rack 20 provide a means for securing the tray to the rack. As shown in the drawings, a plurality of retaining hooks 24 and support members 30 are provided on the rack so that trays 50 can be configured as desired in an adjustable fashion. The arrangement of the retaining hooks 24 and support member 30 in combination with the first wall 58 and second wall 60 of the trays 50 provide an easy means for inserting the trays into the rack. When a tray is to be inserted in the rack 20, the second wall 60 of the tray is fitted between the vertically oriented surface 22 and one of the hooks 24. At the same time, the first wall 58 of the tray is positioned just above the support member 30. Stated otherwise, the tray 50 can then be slid into the rack so that the first wall 58 of the tray 50 is supported by a support member 30 of the rack 20. The retaining hook 24 of the rack 20, in combination with the second wall 60 of the tray 50 prevents the tray 50 from tipping out of the rack 20.

As shown in the drawings, trays 50 incorporating a variety of designs can be used with the rack 20. For example, tray 51 is a bottle holder designed to hold two wine or soda bottles. Tray 52 can be used to hold jars and other containers within the refrigerator, yielding greater overall shelf space than if the refrigerator were used without the improved system of the present invention.

The forgoing description of the preferred embodiment of the invention is not intended to be limiting. In accordance with the patent statutes, changes may be made in the disclosed storage system without actually departing from the true spirit and scope of the invention as defined by the claims set forth below.

What is claimed is:

1. An improved storage system in which a plurality of trays, each including a receptacle, are configured to be mounted in selected positions adjacent one another on a rack, the improvement comprising:

(a) said rack including (i) a vertically oriented surface, (ii) a plurality of retaining hooks projecting from said vertically oriented surface, each retaining hook having an inner surface, (iii) a plurality of support members projecting from said vertically oriented surface, each support member associated with at least one of said retaining hooks, and (iv) at least one mounting member projecting above said vertically oriented surface and terminating in an inwardly extending top flange, and (v) a biasing member cooperating with said mounting member to hold the rack in a desired position; and (b) each of said plurality of trays including an attachment member having a first wall projecting outwardly from the receptacle and a second wall projecting upwardly from said first wall so that when said tray is mounted to said rack, said first wall rests on at least one of said support members of said rack and said second wall engages the inner surface of at least one of said retaining hooks of said rack.

2. The improved storage system of claim 1 wherein said biasing member has a top portion which is forked.

3. The improved storage system of claim 1 wherein at least one of said trays is designed to hold a pair of bottles.

4. The improved storage system of claim 1 wherein at least one of said trays can hold a plurality of items.

* * * * *